US011691251B2

(12) United States Patent
Liao et al.

(10) Patent No.: US 11,691,251 B2
(45) Date of Patent: Jul. 4, 2023

(54) ADJUSTABLE WRENCH

(71) Applicant: Hanlong Industrial Co., Ltd., New Taipei (TW)

(72) Inventors: Chien-Chou Liao, New Taipei (TW); Chien-Wei Huang, New Taipei (TW)

(73) Assignee: Hanlong Industrial Co., Ltd., New Taipei (TW)

( * ) Notice: Subject to any disclaimer, the term of this patent is extended or adjusted under 35 U.S.C. 154(b) by 188 days.

(21) Appl. No.: 17/231,198

(22) Filed: Apr. 15, 2021

(65) Prior Publication Data

US 2022/0219292 A1 Jul. 14, 2022

(30) Foreign Application Priority Data

Jan. 14, 2021 (TW) ..... 110101511

(51) Int. Cl.
*B25B 13/14* (2006.01)

(52) U.S. Cl.
CPC ..... *B25B 13/14* (2013.01)

(58) Field of Classification Search
CPC ..... B25B 13/12; B25B 13/14; B25B 13/16; B25B 13/22; B25B 13/24
See application file for complete search history.

(56) References Cited

U.S. PATENT DOCUMENTS 890,111 A * 6/1908 Walden ..... B25B 13/22 81/135
1,195,020 A * 8/1916 Hughey ..... B25B 13/22 81/134
1,437,774 A * 12/1922 Piechocki ..... B25B 13/22 81/137
2,659,259 A * 11/1953 Jones ..... B25B 13/24 81/148
3,327,574 A * 6/1967 Webbeking ..... B25B 13/22 81/145
3,358,534 A * 12/1967 O'Quinn ..... B25B 13/22 81/145
3,625,096 A * 12/1971 Myers ..... B25B 13/12 81/10
4,028,969 A * 6/1977 Politte ..... B25B 13/22 81/146
4,151,763 A 5/1979 Colvin
6,305,249 B1 10/2001 Wang
(Continued)

FOREIGN PATENT DOCUMENTS

EP 1810786 A2 7/2007
EP 3689546 A1 8/2020

*Primary Examiner* — David B. Thomas
(74) *Attorney, Agent, or Firm* — Alan D. Kamrath; Karin L. Williams; Mayer & Williams PC

(57) ABSTRACT

An adjustable wrench is disclosed. The adjustable wrench is used for an assembly part. The adjustable wrench includes a frame and an adjustable member. An inner side of the frame has a first rack. The adjustable member has a second rack meshed with the first rack. The adjustable member and the frame are meshed with each other by the first rack and the second rack such that the adjustable member forms a first space inside the frame, wherein the adjustable member adjusts a meshing position of the second rack and the first rack to change the size of the first space; thus, the first space can match assembly parts of different specifications.

10 Claims, 17 Drawing Sheets

(56) References Cited

U.S. PATENT DOCUMENTS

| | | | | |
|---|---|---|---|---|
| 7,140,276 | B1 * | 11/2006 | Jeng | B25B 13/12 81/154 |
| 7,281,453 | B2 * | 10/2007 | Wu | B25B 13/22 81/145 |
| 7,748,299 | B2 * | 7/2010 | Wu | B25B 13/22 81/145 |
| 9,242,352 | B2 * | 1/2016 | Arbel | B25B 13/22 |
| 2011/0239832 | A1 | 10/2011 | Arbel et al. | |

* cited by examiner

ADJUSTABLE WRENCH

BACKGROUND OF THE INVENTION

1. Field of the Invention

The present invention relates to an adjustable wrench, and more particularly to an adjustable wrench that can be adjusted conveniently and that does not easily cause wear on an assembly part.

2. Description of the Related Art

As technology develops, many different types of adjustable wrenches have been developed to match various assembly parts such as nuts or screws of different sizes. Please refer to FIG. 1, which illustrates an operation view of the adjustable wrench of the prior art.

In the prior art, a monkey wrench 90 which has a movable jaw 91, a stationary jaw 92 and a worm 93 has been developed. The movable jaw 91 and the stationary jaw form the shape of an opening. The worm 93 and the movable jaw 91 cooperate with each other to adjust the position of the movable jaw 91 so as to change the size of the opening. In this way, the monkey wrench 90 can be applied to assembly parts N of different sizes.

However, because the shape of the opening does not match the hexagon of the assembly part N, when the monkey wrench 90 of the prior art rotates the assembly part N, the monkey wrench 90 contacts the assembly part N only at certain points, wherein the number of contact points may be only two to three. When the monkey wrench 90 applies force only to the contact points of assembly part N for a long time, abrasion of the assembly part N can easily occur.

Therefore, it is necessary to invent a new adjustable wrench to mitigate and/or obviate the aforementioned problems.

SUMMARY OF THE INVENTION

It is a primary object of the present invention to provide an adjustable wrench that is capable of being adjusted conveniently and that does not easily cause wear on an assembly part.

To achieve the above objective, an adjustable wrench of the present invention is used for an assembly part. The adjustable wrench comprises a frame and an adjustable member. An inner side of the frame has a first rack. The adjustable member has a second rack meshed with the first rack. The adjustable member and the frame are meshed with each other by the first rack and the second rack such that the adjustable member forms a first space inside the frame, wherein the adjustable member adjusts a meshing position of the second rack and the first rack to change the size of the first space such that the first space can match assembly parts of different specifications.

DETAILED DESCRIPTION OF THE PREFERRED EMBODIMENTS

The advantages and innovative features of the invention will become more apparent from the following detailed descriptions when taken in conjunction with the accompanying drawings.

Figure 1:
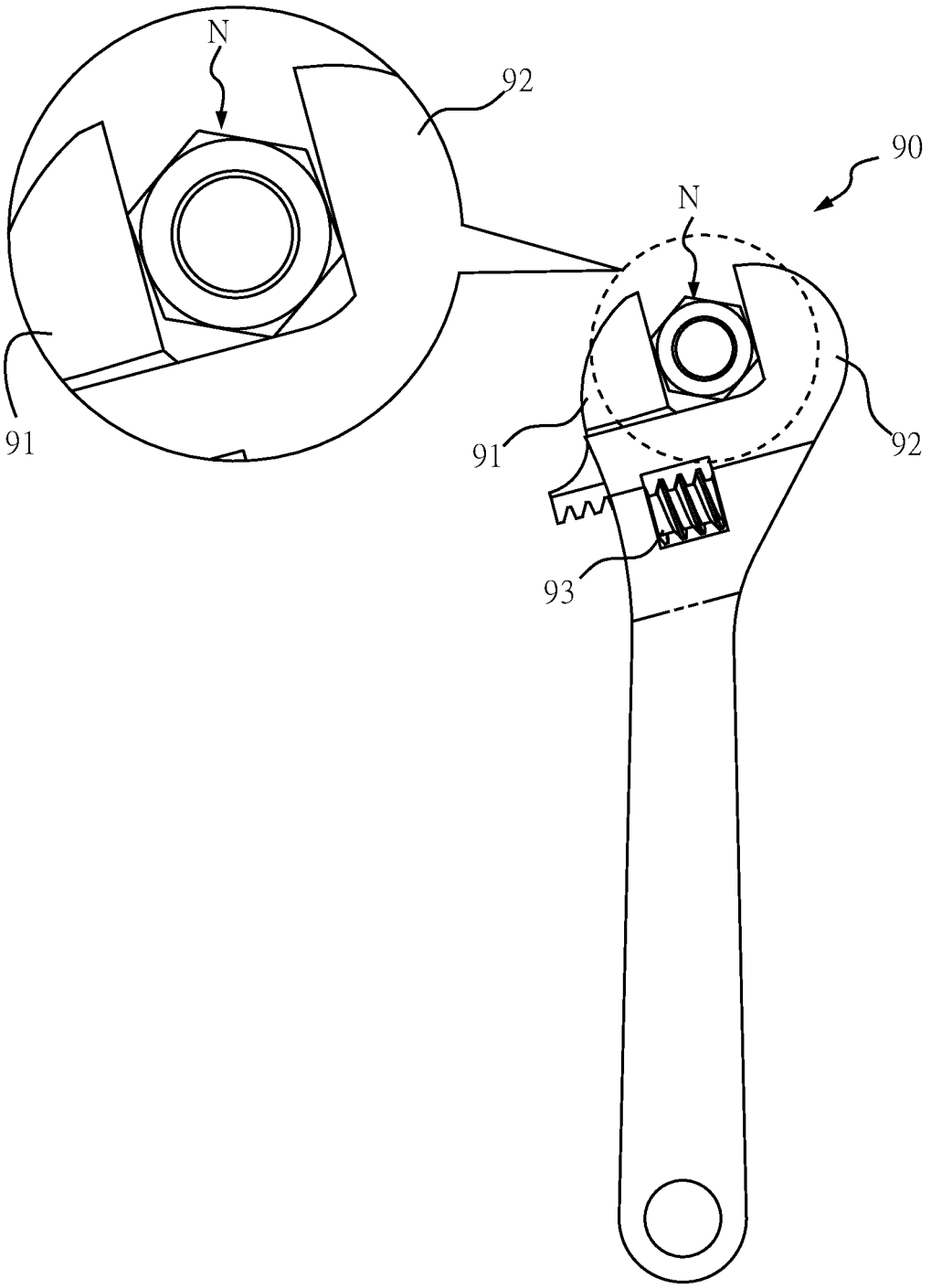
Fig. 1 (Prior Art)
FIG. 1 illustrates an operation view of an adjustable wrench of the prior art.
Figure 2A:
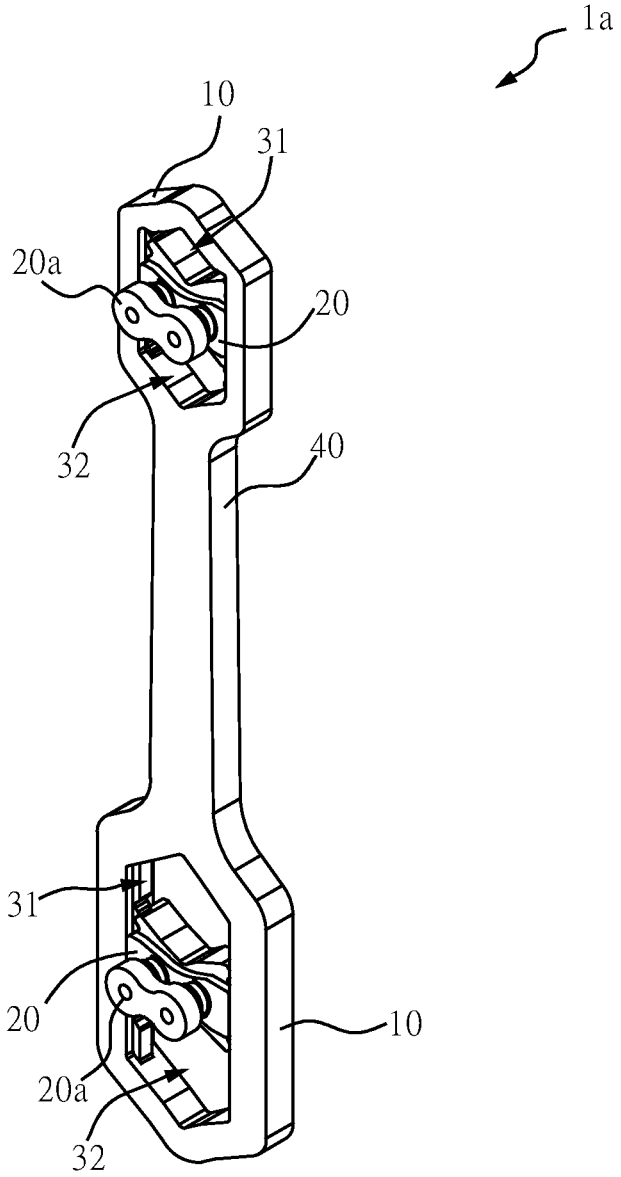
FIG. 2A illustrates a stereogram of an adjustable wrench in the first embodiment of the present invention.
Figure 2B:
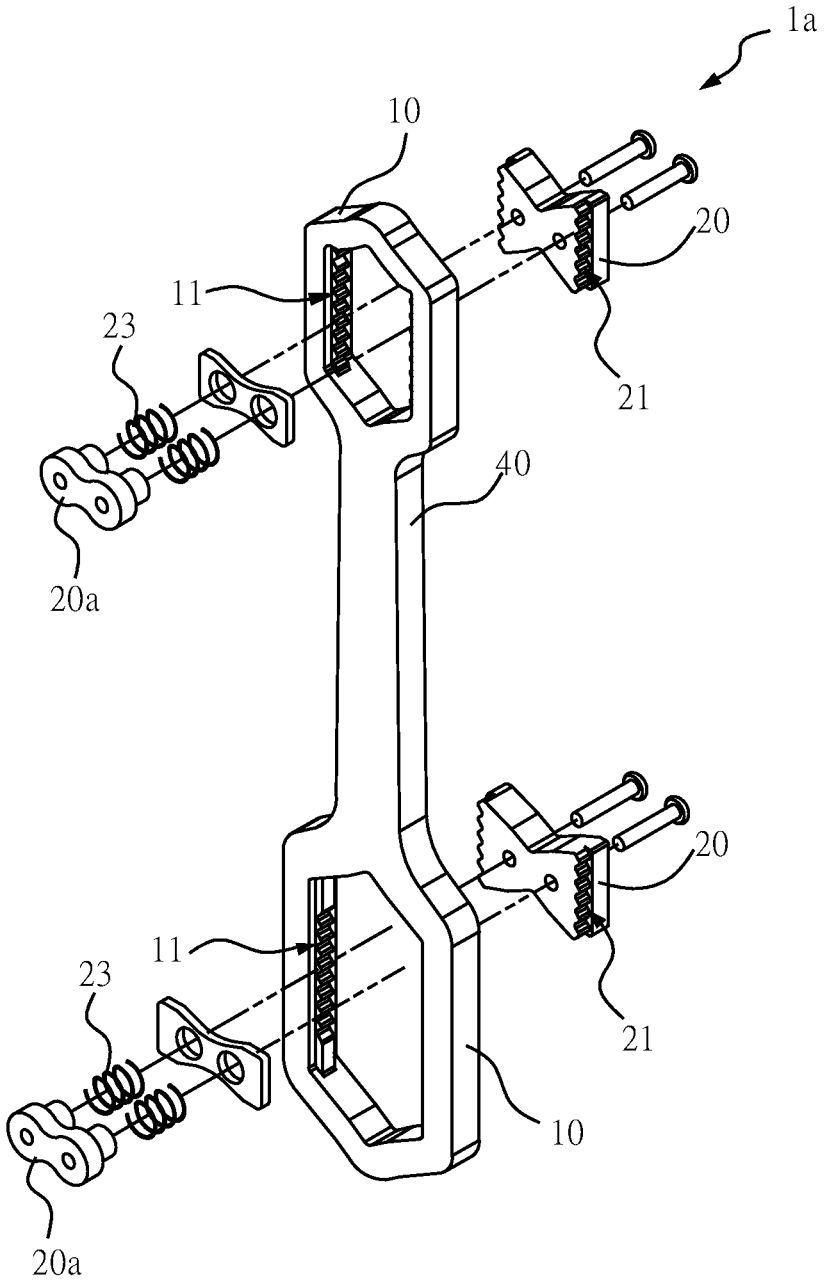
FIG. 2B illustrates an exploded view of the adjustable wrench in the first embodiment of the present invention.

Hereafter, please refer to FIG. 2A, which illustrates a stereogram of an adjustable wrench in the first embodiment of the present invention, and FIG. 2B, which illustrates an exploded view of the adjustable wrench in the first embodiment of the present invention.

In the first embodiment of the present invention, the adjustable wrench 1*a* comprises a frame 10, an adjustable member 20, and an engaging element 51 used for engaging the frame 10 with the adjustable member 20. The adjustable member 20 has a second rack 21. The second rack 21 is meshed with the first rack 11. Therefore, the adjustable member 20 is meshed with the frame 10 to form a first space 31 and a second space 32 inside the frame 10. The first space 31 and the second space 32 are formed on both sides of the adjustable member 20. The adjustable member 20 adjusts a meshing position of the second rack 21 and the first rack 11 to change the size of the first space 31 and the second space 32. It should also be noted that the adjustable wrench 1*a* may also form a single space due to the relationship between the frame 10 and the shape of the adjustable member 20. As a result, in the first embodiment of the present invention, the minimum shape of the first space 31 and the second space 32 can be a quadrilateral, and after adjustment, the first space 31 and the second space can be adjusted to form a hexagon.

Figure 2C:
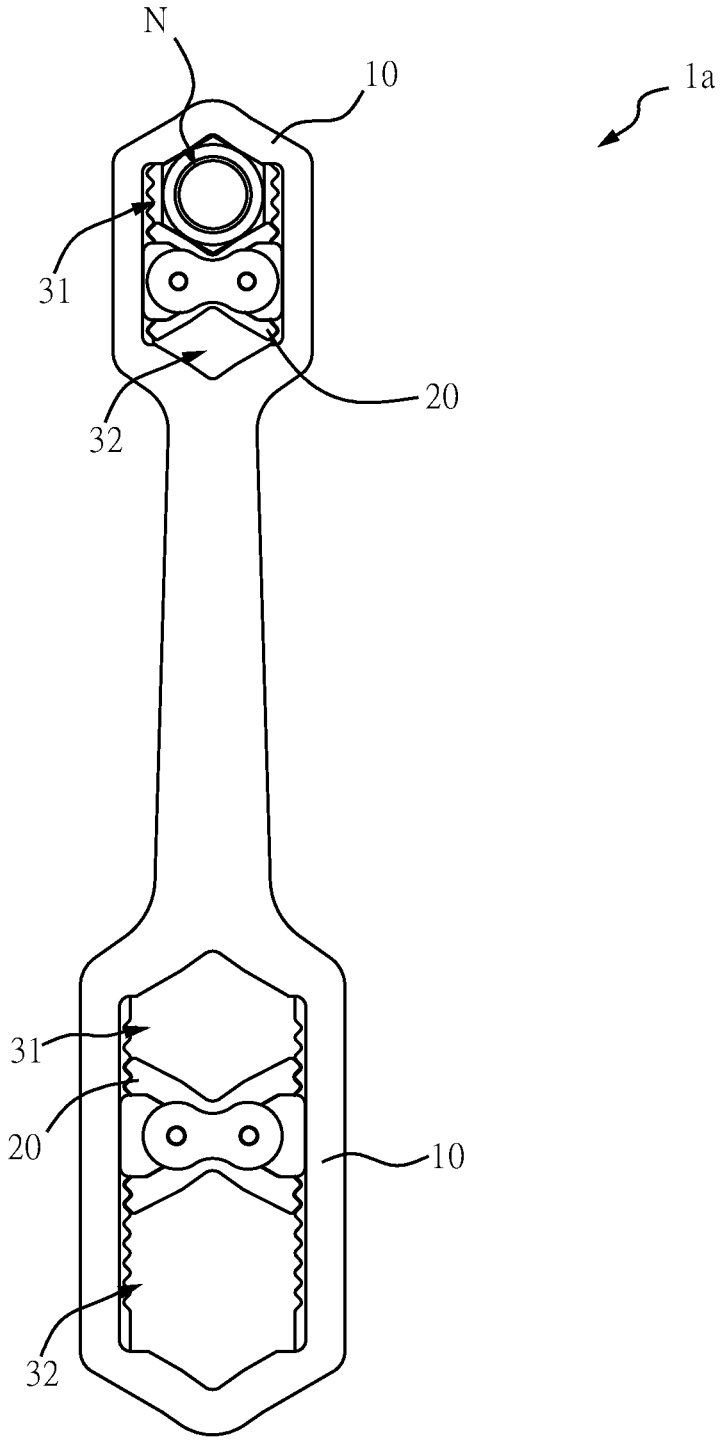
FIG. 2C illustrates an operation view of the adjustable wrench in the first embodiment of the present invention.

Please refer to FIG. 2C, which illustrates an operation view of the adjustable wrench in the first embodiment of the present invention.

The adjustable wrench 1*a* can be suitable for an assembly part N, which may be parts such as screws, nuts, etc. The present invention does not limit the types of the assembly part N. The shape of the assembly part N in FIG. 2C is hexagonal as an example, but the shape of the assembly part N can also be a circle or other polygons. The present invention is not limited thereto. The sizes of the first space 31 and the second space 32 are matched with the specifications of the assembly part N. When the assembly part N is placed into the first space 31 and the second space 32, the first space 31 and the second space 32 are in contact with the assembly part N on at least four sides. Therefore, when the adjustable wrench 1*a* rotates, the force applied to each side of the assembly part N can be more even, and the wear on the assembly part N can be greatly reduced. Further, in the first embodiment of the present invention, the long handle 40 of the adjustable wrench 1*a* is used to connect the two frames 10 at the same time. The sizes of the two frames 10 can be different. By matching of the size of the first space 31 and the second space 32 of each frame 10, the adjustable wrench 1*a* can be applied to assembly parts N of at least four different specifications. Furthermore, the shapes of the first space 31 and the second space 32 can also be adjusted, so the applicable specifications of the assembly parts N are more diverse.

Figure 3B:
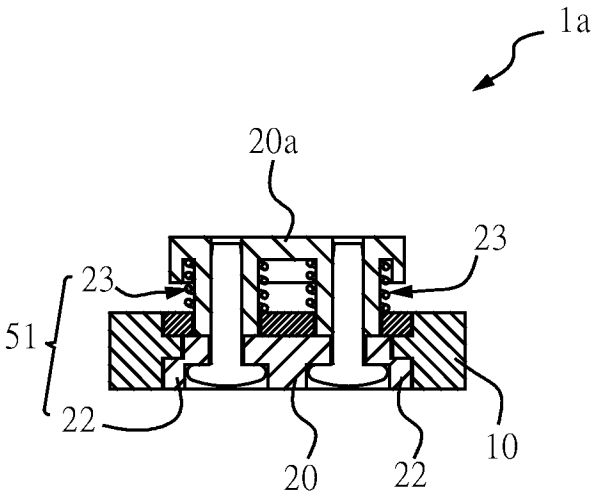
FIG. 3B illustrates a cutaway drawing of the adjustable wrench in the first embodiment of the present invention along the A-A direction of FIG. 3A.
Figure 3A:
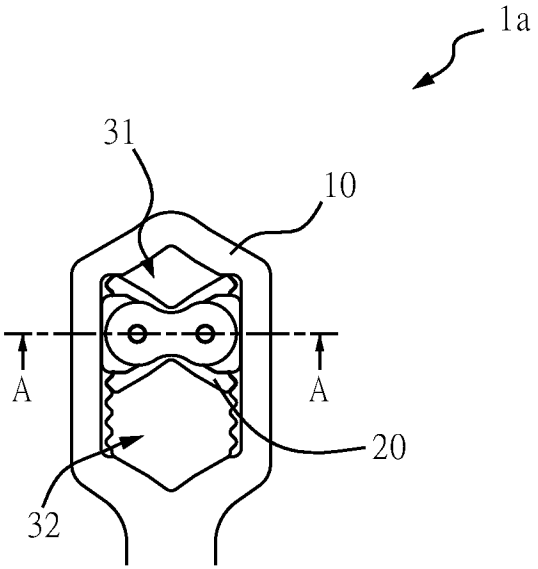
FIG. 3A illustrates a front view of a first state of the adjustable wrench in the first embodiment of the present invention.
Figure 3D:
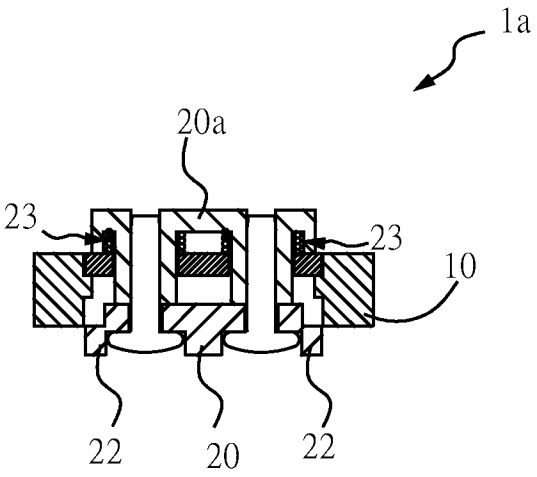
FIG. 3D illustrates a cutaway drawing of the adjustable wrench in the first embodiment of the present invention along the A-A direction of FIG. 3C.
Figure 3C:
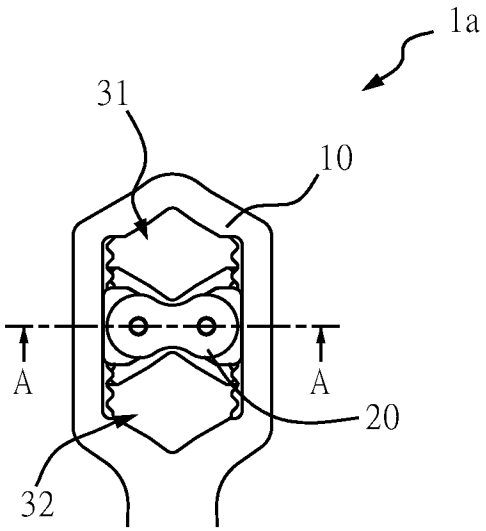
FIG. 3C illustrates a front view of a second state of the adjustable wrench in the first embodiment of the present invention.
Figure 3F:
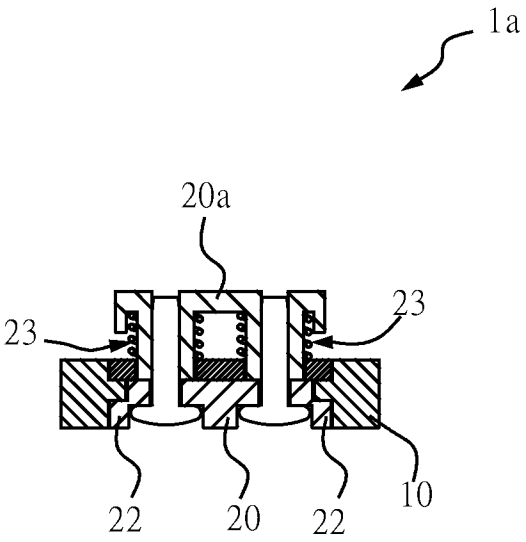
FIG. 3F illustrates a cutaway drawing of the adjustable wrench in the first embodiment of the present invention along the A-A direction of FIG. 3E.
Figure 3E:
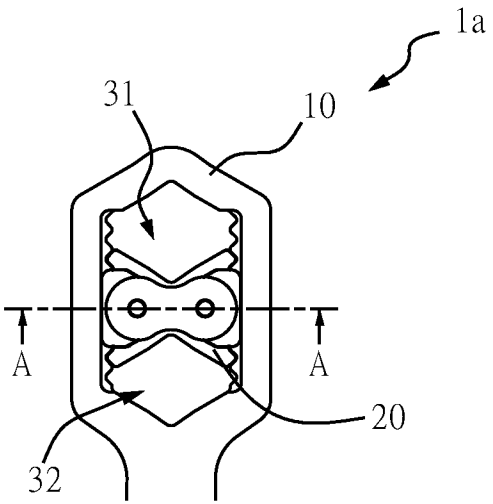
FIG. 3E illustrates a front view of a third state of the adjustable wrench in the first embodiment of the present invention.

Please refer to FIGS. 3A to 3F for the method of adjusting the position of the adjustable member 20, wherein FIG. 3A illustrates a front view of a first state of the adjustable wrench in the first embodiment of the present invention, FIG. 3B illustrates a cutaway drawing of the adjustable wrench in the first embodiment of the present invention along the A-A direction of FIG. 3A, FIG. 3C illustrates a front view of a second state of the adjustable wrench in the first embodiment of the present invention, FIG. 3D illustrates a cutaway drawing of the adjustable wrench in the first embodiment of the present invention along the A-A direction of FIG. 3C, FIG. 3E illustrates a front view of a third state of the adjustable wrench in the first embodiment of the present invention, and FIG. 3F illustrates a cutaway drawing of the adjustable wrench in the first embodiment of the present invention along the A-A direction of FIG. 3E.

In the first embodiment of the present invention, the adjustable wrench 1*a* utilizes its engaging element 51 to engage the frame 10 and the adjustable member 20 with each other. In the first embodiment of the present invention, the engaging element 51 comprises a bulge part 22 and a first elastic element 23. The bulge part 22 extends from the left and right sides of the adjustable member 20 and cooperates with the frame 10. Moreover, the first elastic element 23 is disposed on the bulge part 22 so as to abut against the frame 10 vertically. At this time, as shown in FIG. 3A and FIG. 3B, when the pressing portion 20*a* and the first elastic element 23 disposed on one side of the adjustable member 20 are pressed, the first elastic element 23 is compressed. Thus, the first rack 11 and the second rack 21 can be separated up and down, as shown in FIG. 3C and FIG. 3D. Then the adjustable member 20 can be moved. When the adjustable member 20 is moved to the position, the pressing portion 20*a* of the adjustable member 20 is no longer pressed, and the first elastic element 23 provides an elastic force so that the second rack 21 and the first rack 11 are meshed with each other.

Figure 4C:
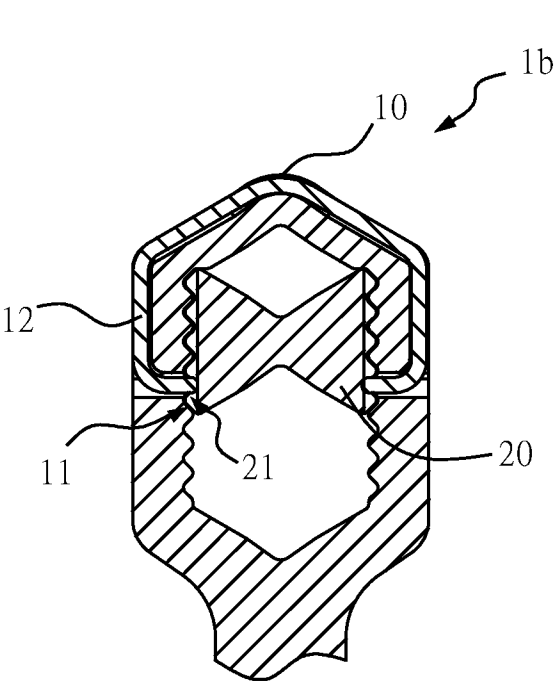
FIG. 4C illustrates a cutaway drawing of the adjustable wrench in the second embodiment of the present invention along the A-A direction of FIG. 4B.
Figure 4B:
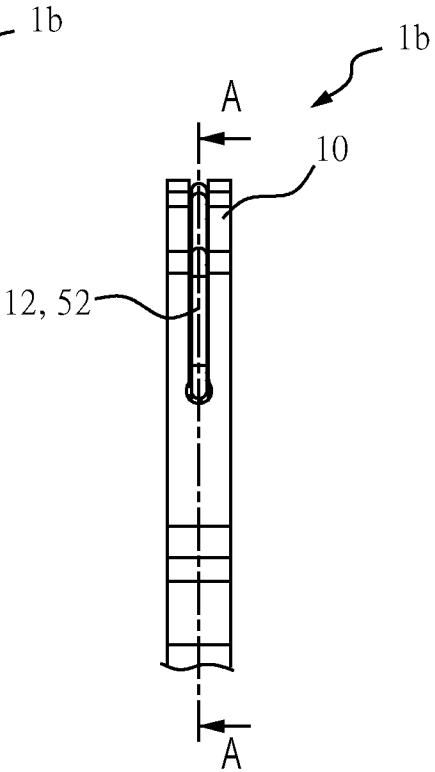
FIG. 4B illustrates a side view of the adjustable wrench in the second embodiment of the present invention.
Figure 4A:
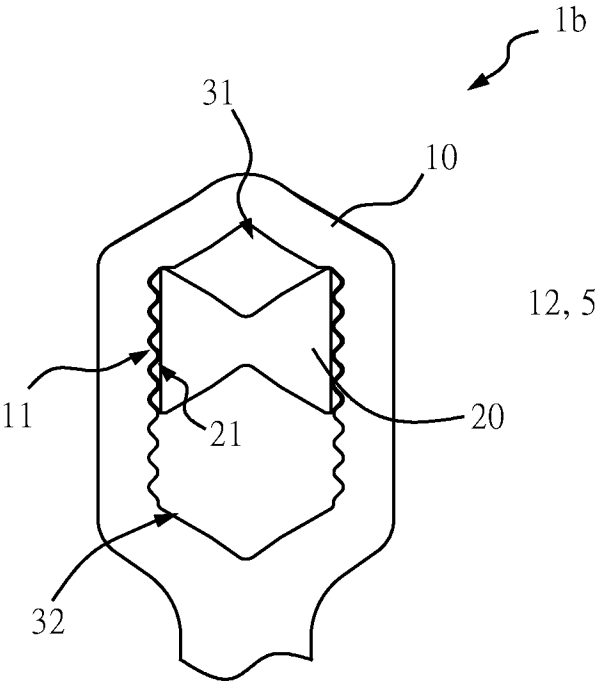
FIG. 4A illustrates a front view of the adjustable wrench in a second embodiment of the present invention.

Now please refer to FIG. 4A to 4C, wherein FIG. 4A illustrates a front view of the adjustable wrench in a second embodiment of the present invention, FIG. 4B illustrates a side view of the adjustable wrench in the second embodiment of the present invention, and FIG. 4C illustrates a cutaway drawing of the adjustable wrench in the second embodiment of the present invention along the A-A direction of FIG. 4B.

In the second embodiment of the present invention, the engaging element 52 of the adjustable wrench 1*b* comprises a fixing ring 12. The fixing ring 12 has elasticity, is disposed on a part of the periphery of the frame 10, and passes through the frame 10 and the first rack 11 to contact the second rack 21 so as to engage the adjustable member 20. Therefore, the adjustable member 20 can be separated from or assembled with the frame 10. When the adjustable member 20 is assembled with the frame 10, the adjustable member 20 engages the second rack 21 with the first rack 11 and fixes the adjustable member 20 by the elastic force of the fixing ring 12.

Figure 5C:
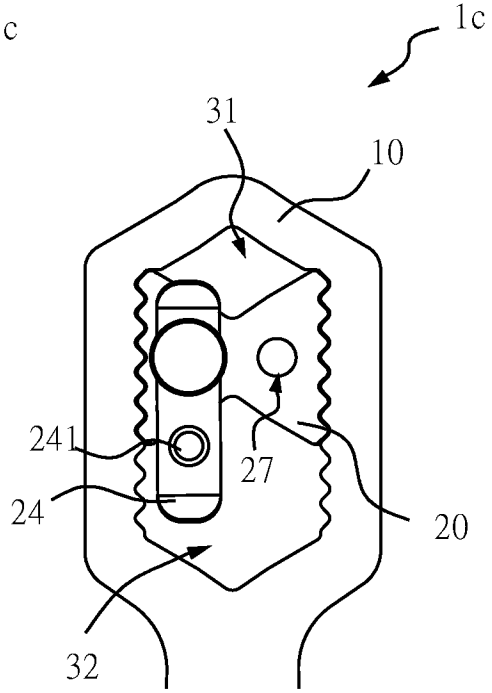
FIG. 5C illustrates a front view of another state of the adjustable wrench in the third embodiment of the present invention.
Figure 5B:
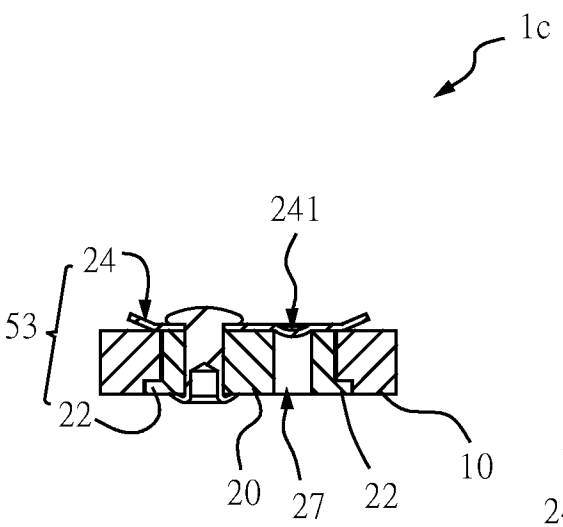
FIG. 5B illustrates a cutaway drawing of the adjustable wrench in the third embodiment of the present invention along the A-A direction of FIG. 5A.
Figure 5A:
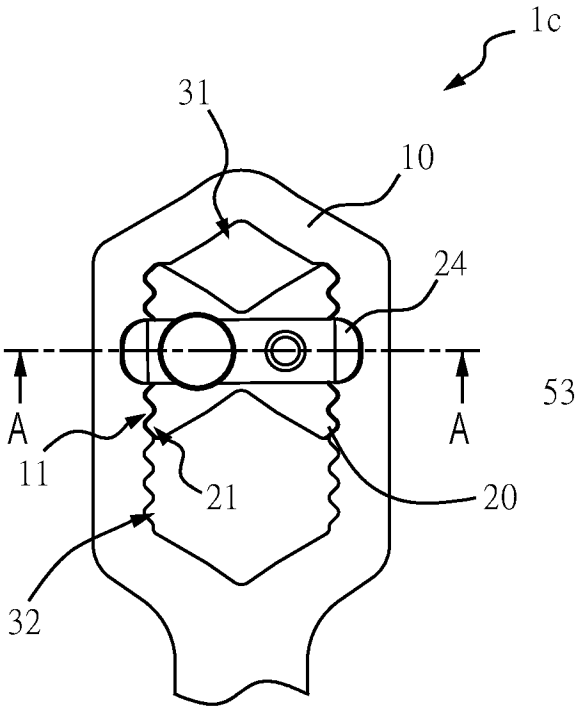
FIG. 5A illustrates a front view of the adjustable wrench in a third embodiment of the present invention.

Now please refer to FIG. 5A to 5C, wherein FIG. 5A illustrates a front view of the adjustable wrench in a third embodiment of the present invention, FIG. 5B illustrates a cutaway drawing of the adjustable wrench in the third embodiment of the present invention along the A-A direction of FIG. 5A, and FIG. 5C illustrates a front view of another state of the adjustable wrench in the third embodiment of the present invention.

In the third embodiment of the present invention, the engaging element 53 of the adjustable wrench 1*c* comprises a bulge part 22 and a baffle 24. The baffle 24 is pivotally connected to the adjustable member 20 so as to be rotatable. As shown in FIGS. 5A-5C, when the baffle 24 is horizontal, the adjustable member 20 can be fixed to the frame 10 by using the bulge part 22 and the baffle 24. The baffle 24 can further have a bump 241, which can be engaged with the hole 27. After the baffle 24 is rotated to vertical or other inclined angles, the adjustable member 20 can be released from the frame 10. Then when the adjustable member 20 is moved to the position, the second rack 21 and the first rack 11 are meshed with each other. Finally, the baffle 24 is rotated back to the horizontal to fix the adjustable member 20. Thus, the sizes of the first space 31 and the second space 32 can be adjusted.

Figure 6C:
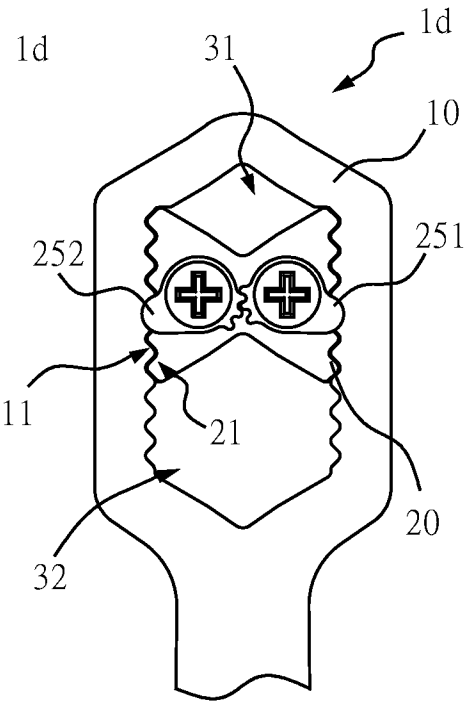
FIG. 6C illustrates a front view of another state of the adjustable wrench in the fourth embodiment of the present invention.
Figure 6B:
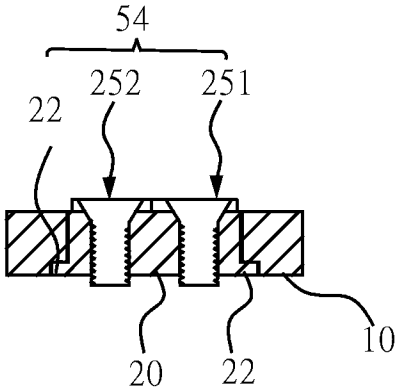
FIG. 6B illustrates a cutaway drawing of the adjustable wrench in the fourth embodiment of the present invention along the A-A direction of FIG. 6A.
Figure 6A:
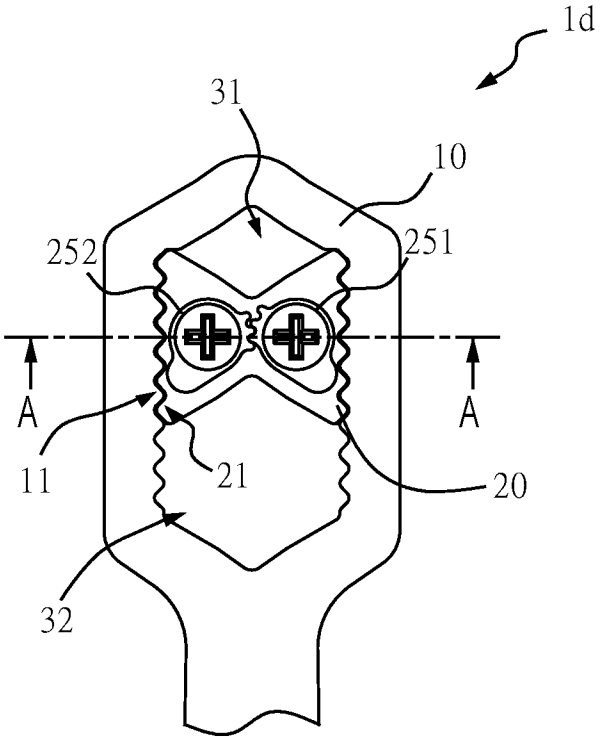
FIG. 6A illustrates a front view of the adjustable wrench in a fourth embodiment of the present invention.

Now please refer to FIG. 6A to 6C, wherein FIG. 6A illustrates a front view of the adjustable wrench in a fourth embodiment of the present invention, FIG. 6B illustrates a cutaway drawing of the adjustable wrench in the fourth embodiment of the present invention along the A-A direction of FIG. 6A, and FIG. 6C illustrates a front view of another state of the adjustable wrench in the fourth embodiment of the present invention.

In the fourth embodiment of the present invention, the engaging element 54 of the adjustable wrench 1*d* comprises the bulge part 22, a first rotation fixing member 251, and a second rotation fixing member 252. The first rotation fixing member 251 and the second rotation fixing member 252 are pivotally connected to the adjustable member 20 and engaged with each other such that they are able to rotate with each other. Therefore, when the first rotation fixing member 251 and the second rotation fixing member 252 are both turned to the horizontal direction, the adjustable member 20 can be fixed to the frame 10 by the bulge part 22, the first rotation fixing member 251, and the second rotation fixing member 252. When the first rotation fixing member 251 and the second rotation fixing member 252 are rotated to vertical or other inclined angles, the adjustable member 20 can be separated from the frame 10. Then when the adjustable member 20 is moved to the position, the second rack 21 and the first rack 11 are meshed with each other. Finally, the first rotation fixing member 251 and the second rotation fixing member 252 are rotated back to the original horizontal state to fix the adjustable member 20 and the frame 10. In this way, the sizes of the first space 31 and the second space 32 can be adjusted.

Figure 7C:
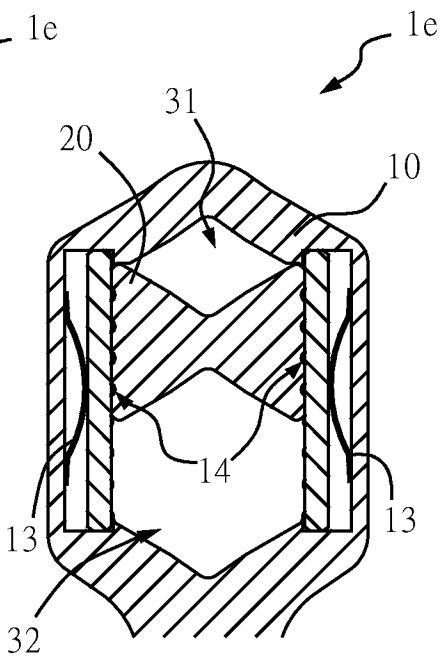
FIG. 7C illustrates a cutaway drawing of the adjustable wrench in the fifth embodiment of the present invention along the B-B direction of FIG. 7B.
Figure 7B:
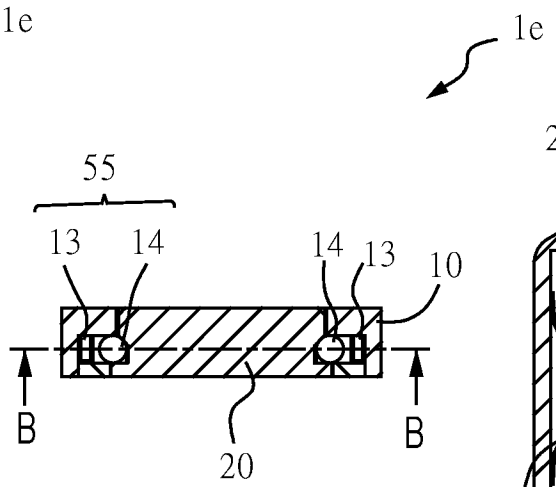
FIG. 7B illustrates a cutaway drawing of the adjustable wrench in the fifth embodiment of the present invention along the A-A direction of FIG. 7A.
Figure 7A:
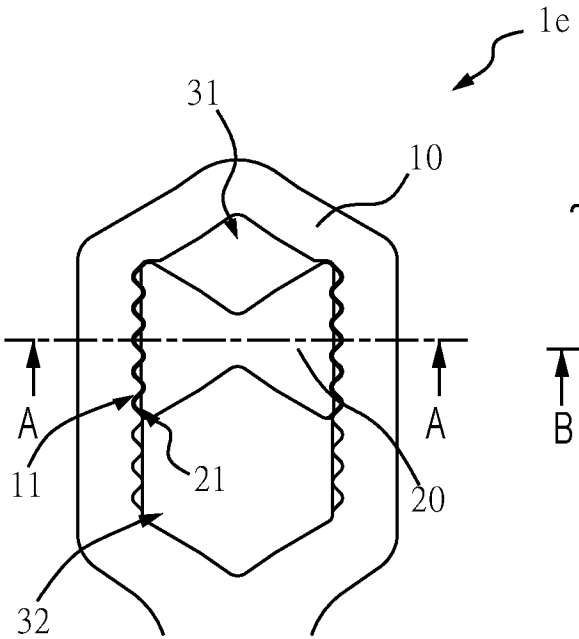
FIG. 7A illustrates a front view of the adjustable wrench in a fifth embodiment of the present invention.

Now please refer to FIG. 7A to 7C, wherein FIG. 7A illustrates a front view of the adjustable wrench in a fifth embodiment of the present invention, FIG. 7B illustrates a cutaway drawing of the adjustable wrench in the fifth embodiment of the present invention along the A-A direction of FIG. 7A, and FIG. 7C illustrates a cutaway drawing of the adjustable wrench in the fifth embodiment of the present invention along the B-B direction of FIG. 7B.

In the fifth embodiment of the present invention, the engaging element 55 of the adjustable wrench 1*e* comprises a second elastic element 13 and a roller pin 14. The second elastic element 13 can be a strip or sheet, which is abutting against the first rack 11. The roller pin 14 is arranged on the first rack 11 such that the adjustable member 20 can be moved along the roller pin 14. After the adjustable member 20 is moved to the position, the elastic force provided by the second elastic element 13 causes the second rack 21 and the first rack 11 to be meshed with each other. Therefore, the meshing position of the second rack 21 and the first rack 11 can be adjusted.

Figure 8C:
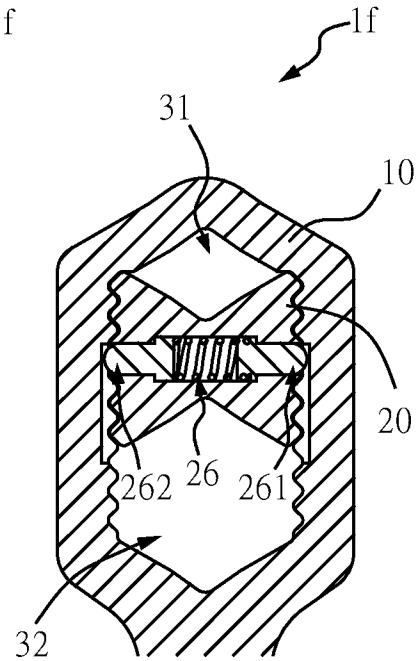
FIG. 8C illustrates a cutaway drawing of the adjustable wrench in the sixth embodiment of the present invention along the B-B direction of FIG. 8B.
Figure 8B:
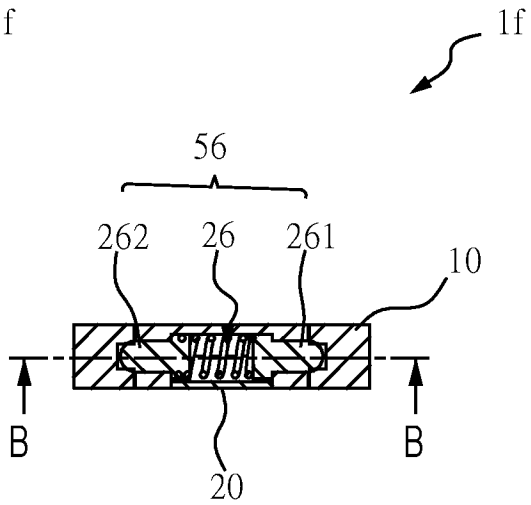
FIG. 8B illustrates a cutaway drawing of the adjustable wrench in the sixth embodiment of the present invention along the A-A direction of FIG. 8A.
Figure 8A:
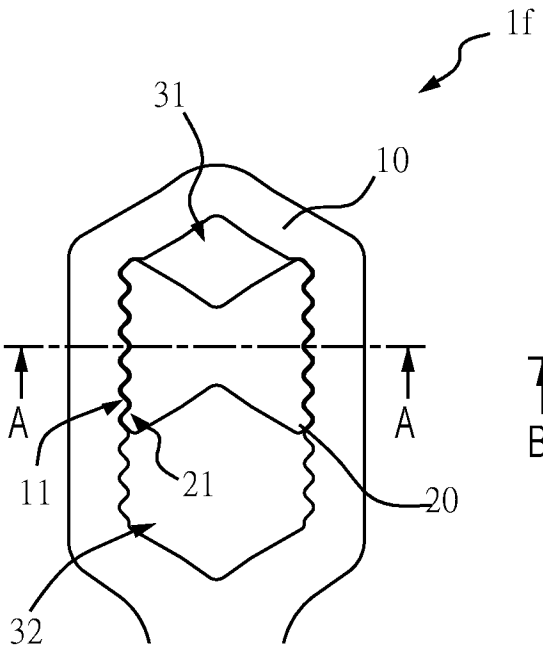
FIG. 8A illustrates a front view of the adjustable wrench in a sixth embodiment of the present invention.

Now please refer to FIG. 8A to 8C, wherein FIG. 8A illustrates a front view of the adjustable wrench in a sixth embodiment of the present invention, FIG. 8B illustrates a cutaway drawing of the adjustable wrench in the sixth embodiment of the present invention along the A-A direction of FIG. 8A, and FIG. 8C illustrates a cutaway drawing of the adjustable wrench in the sixth embodiment of the present invention along the B-B direction of FIG. 8B.

In the sixth embodiment of the present invention, the engaging element 56 of the adjustable wrench 1*f* comprises a third elastic element 26 which is horizontally arranged in the adjustable member 20. The third elastic element 26 comprises a first end 261 and a second end 262. The first end 261 and the second end 262 are protruded from the second rack 21 to abut against the first rack 11 respectively. The third elastic element 26 provides the required elastic force when the first end 261 and the second end 262 abut against the first rack 11. Therefore, when the adjustable member 20 is assembled with the frame 10, the elastic force provided by the third elastic element 26 can cause the adjustable member 20 and the frame 10 to engage with each other. Thus, the adjustable member 20 can adjust the meshing position of the second rack 21 and the first rack 11.

Figure 9A:
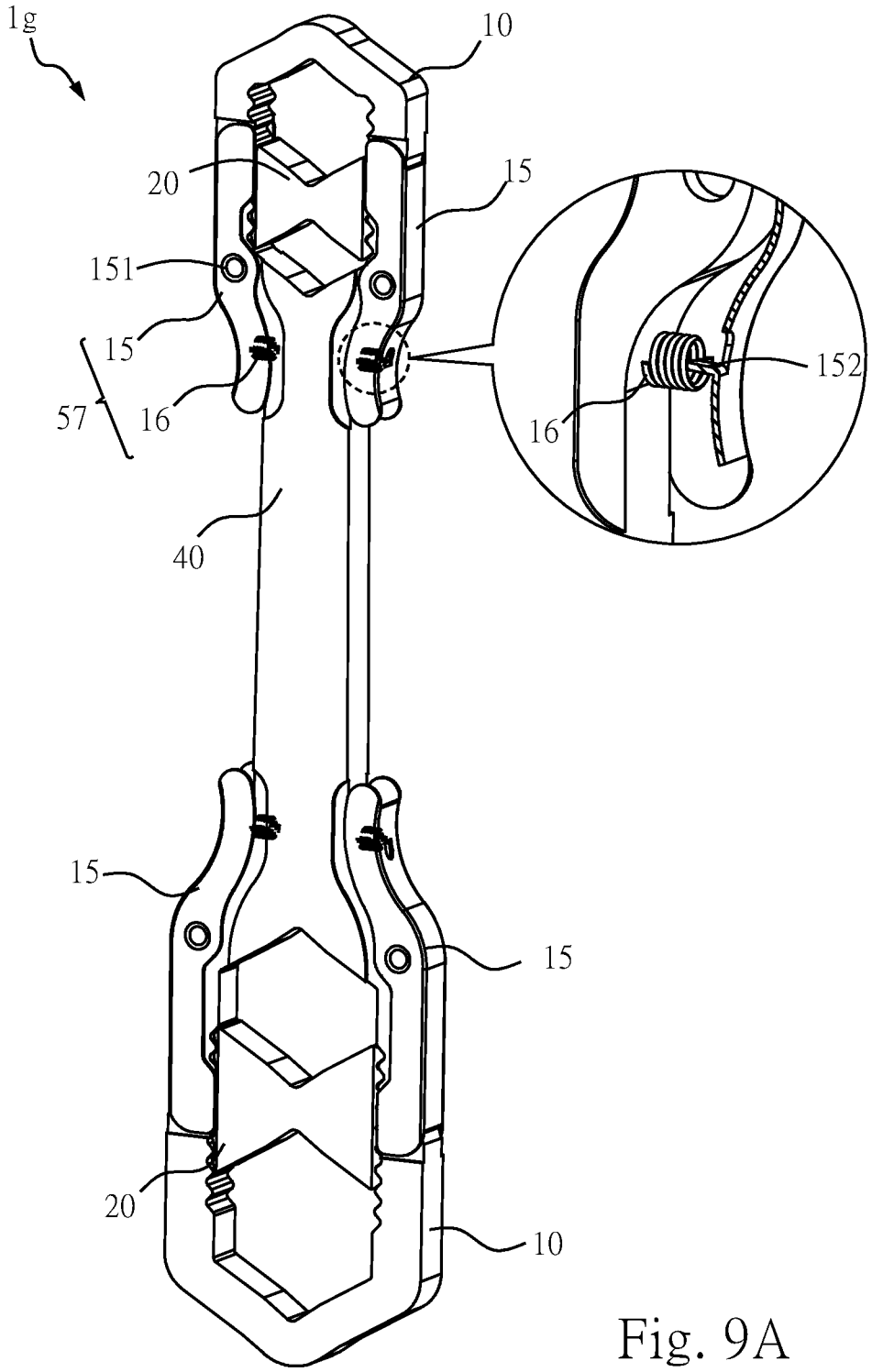
FIG. 9A illustrates a schematic diagram of the adjustable wrench in a seventh embodiment of the present invention.
Figure 9B:
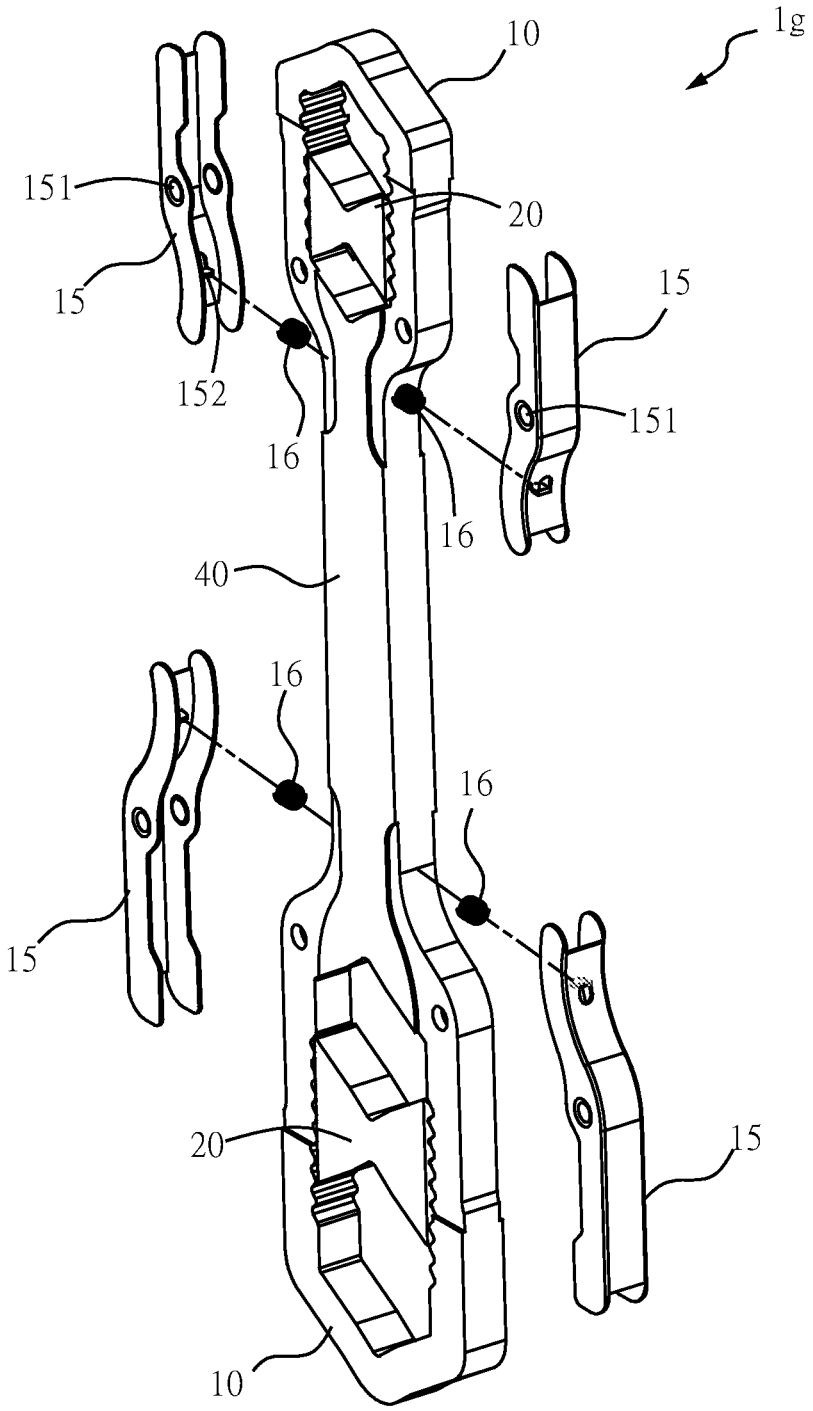
FIG. 9B illustrates a partial exploded schematic diagram of the adjustable wrench in the seventh embodiment of the present invention.

Now please refer to FIG. 9A, which illustrates a schematic diagram of the adjustable wrench in a seventh embodiment of the present invention, and FIG. 9B, which illustrates a partial exploded schematic diagram of the adjustable wrench in the seventh embodiment of the present invention.

In the seventh embodiment of the present invention, the engaging element 57 of the adjustable wrench 1*g* comprises a fixture 15 and a fourth elastic element 16. The fixture 15 further comprises a pivot point 151 and a positioner 152. The fixture 15 is pivotally connected to the frame 10 via the pivot point 151. The fourth elastic element 16 is located on the frame 10 and contacts the fixture 15 via the positioning member positioner 152 of the fixture 15 so as to provide an elastic force. Therefore, the fixture 15 can clamp the adjustable member 20. Specifically, the fixture 15 will block the meshing position between the first rack 11 and the second rack 21, so the adjustable member 20 will not be loosened. After the clamp fixture 15 is pressed, the clamp fixture 15 can loosen the adjustable member 20 so that the adjustable member 20 can be moved to adjust the meshing position of the second rack 21 and the first rack 11.

It should be noted that at least a portion of the engaging elements 51 to 57 of the present invention can be disposed on the frame 10 or on the adjustable member 20 to be engaged with the middle section or on the outside of the frame 10 or on the adjustable member 20 so as to achieve the function of engaging or clamping by stretching or rotating. The present invention is not limited to the engaging elements 51 to 57 as shown in the first to seventh embodiments.

Figure 10A:
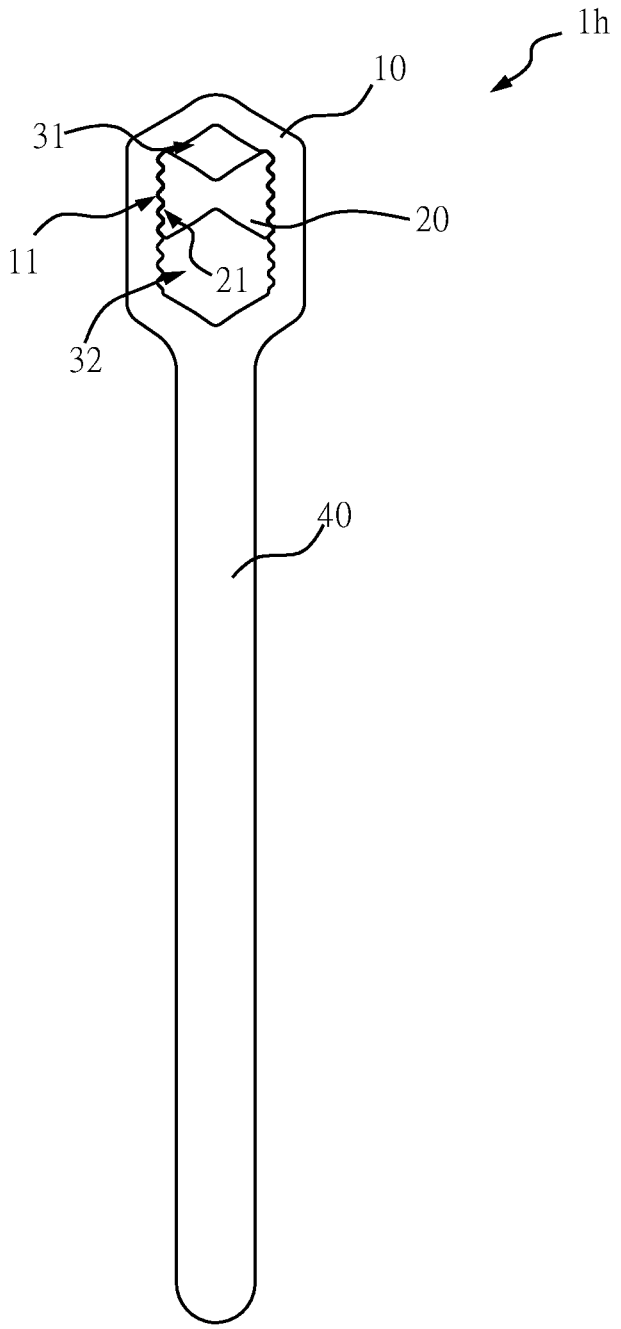
FIG. 10A illustrates a schematic diagram of the adjustable wrench in an eighth embodiment of the present invention.

Now please refer to FIG. 10A, which illustrates a schematic diagram of the adjustable wrench in an eighth embodiment of the present invention.

In the eighth embodiment of the present invention, the handle 40 of the adjustable wrench 1*h* is connected to a single frame 10.

Figure 10B:
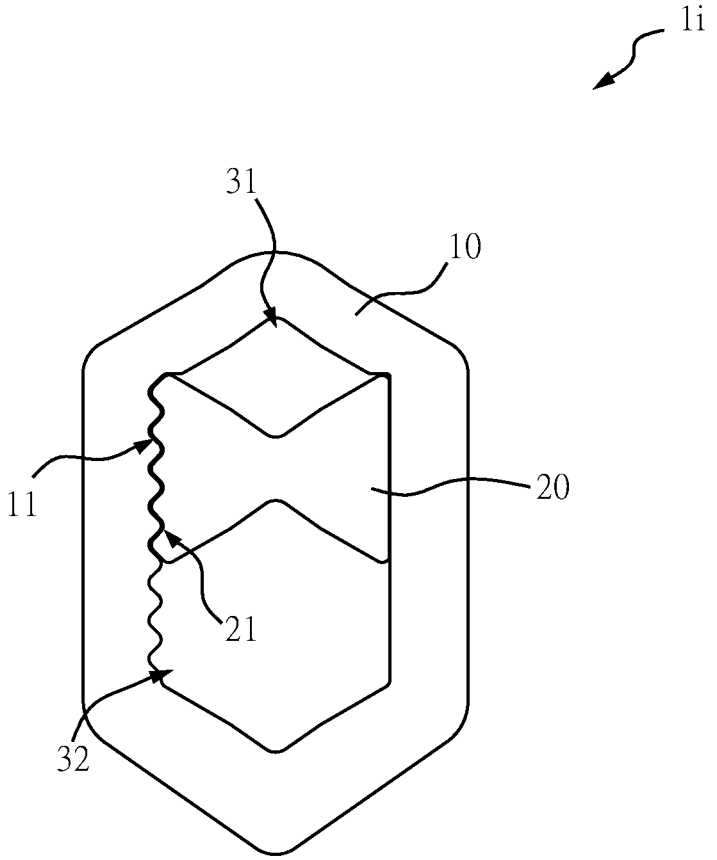
FIG. 10B illustrates a schematic diagram of the adjustable wrench in a ninth embodiment of the present invention.

Please refer to FIG. 10B, which illustrates a schematic diagram of the adjustable wrench in a ninth embodiment of the present invention.

In the ninth embodiment of the present invention, the adjustable wrench 1*i* has only the frame 10 and the adjustable member 20. The frame 10 only provides a single-sided first rack 11, and the adjustable member 20 also provides a single-sided second rack 21. Thus, the user can more easily carry the adjustable wrench 1*i*.

Figure 10D:
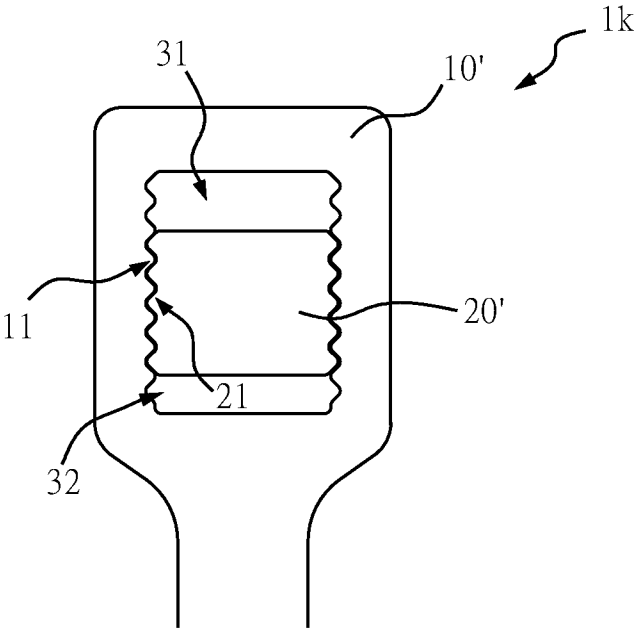
FIG. 10D illustrates a schematic diagram of the adjustable wrench in an eleventh embodiment of the present invention.
Figure 10C:
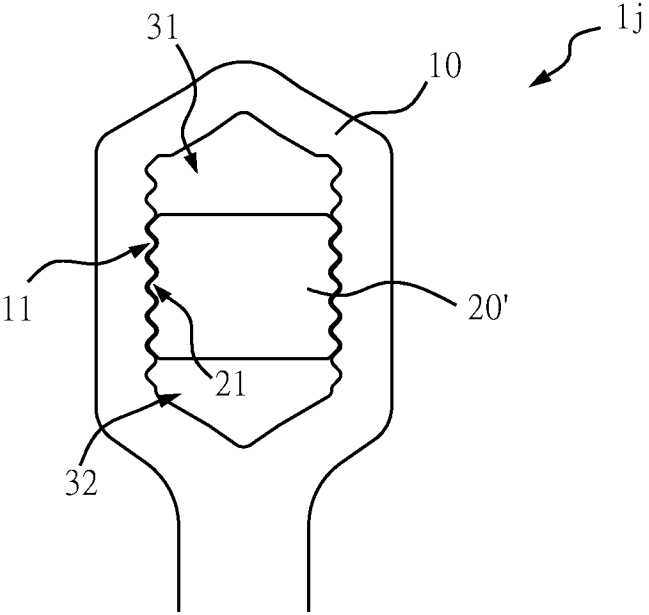
FIG. 10C illustrates a schematic diagram of the adjustable wrench in a tenth embodiment of the present invention.

Please refer to FIG. 10C, which illustrates a schematic diagram of the adjustable wrench in a tenth embodiment of the present invention.

In the tenth embodiment of the present invention, the shape of the frame 10 of the adjustable wrench 1*j* remains hexagonal, but the shape of the adjustable member 20' is similar to a rectangle. Therefore, in this embodiment, the shapes of the first space 31 and the second space 32 are both close to triangular.

Please refer to FIG. 10D, which illustrates a schematic diagram of the adjustable wrench in an eleventh embodiment of the present invention.

In the eleventh embodiment of the present invention, the shape of the frame 10' of the adjustable wrench 1*k* is a rectangle, the shape of the adjustable member 20' is also a rectangle, and the shapes of the first space 31 and the second space 32 are also rectangles.

In addition to the above-mentioned elements, the adjustable wrenches 1*a* to 1*k* of the present invention may also include other elements. Since the technology of other elements is not the focus of the present invention, it will not be further described here. Moreover, the present invention is not limited to the embodiments of the above-mentioned adjustable wrenches 1*a* to 1*k*.

It can be seen from the above description that the adjustable wrenches 1*a* to 1*k* of the present invention allows adjustment of the size of the first space 31 and the second space 32 to match different assembly parts N and reduce the degree of wear on the assembly parts N, so the disadvantages of the prior art can be effectively corrected.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. An adjustable wrench for an assembly, the adjustable wrench comprising:

a frame, an inner side of the frame having a first rack;

an adjustable member, having a second rack meshed with the first rack; the adjustable member and the frame are meshed with each other by the first rack and the second rack, such that the adjustable member forms a first space inside the frame, wherein the adjustable member adjusts a meshing position of the second rack and the first rack to change the size of the first space; thus, the first space can match assembly parts of different specifications; and an engaging element used for engaging the adjustable member and the frame, wherein the engaging element is a fixing ring disposed on the frame and penetrating the first rack to contact the second rack so as to engage the adjustable member.

2. The adjustable wrench as claimed in claim 1, wherein the adjustable member further forms a second space inside the frame, and the first space and the second space are formed in both sides of the adjustable member, wherein when the first space changes, the size of the second space changes relatively.

3. The adjustable wrench as claimed in claim 1, wherein the engaging element comprises:

a bulge part, disposed on the adjustable member and matched with the frame; and a first elastic element, connected to the adjustable member and abutting against the frame; thus, after the adjustable member is pressed, the first elastic element is compressed such that the second rack is separated from the first rack so as to move the adjustable member; when the adjustable member is not pressed, the first elastic element provides an elastic force to cause the second rack to mesh with the first rack again.

4. The adjustable wrench as claimed in claim 1, wherein the engaging element comprises:

a bulge part, disposed on the adjustable member and matched with the frame; and a baffle, pivotally connected to the adjustable member, such that the adjustable member can be fixed to the frame by the bulge part and the baffle, or the adjustable member can loosen with the frame after the baffle rotates, so as to adjust the meshing position of the second rack and the first rack.

5. The adjustable wrench as claimed in claim 1, wherein the engaging element comprises:

a bulge part, disposed on the adjustable member and matched with the frame;

a first rotation fixing member; and a second rotation fixing member, the first rotation fixing member and the second rotation fixing member being pivotally connected to the adjustable member and engaging with each other such that the adjustable member can be fixed to the frame by the bulge part, the first rotation fixing member and the second rotation fixing member; the adjustable member can be separated from the frame after the first rotation fixing member and the second rotation fixing member are rotated so as to adjust the meshing position of the second rack and the first rack.

6. The adjustable wrench as claimed in claim 1, wherein the engaging element comprises:

a second elastic element, abutting against the first rack; and a roller pin, disposed at the first rack, such that the adjustable member can move along the roller pin and cause the second rack and the first rack to mesh with each other according to the elastic force provided by the second elastic element, so as to adjust the meshing position of the second rack and the first rack.

7. The adjustable wrench as claimed in claim 1, wherein the engaging element comprises a third elastic element disposed in the adjustable member; the third elastic element comprises a first end and a second end which are abutting against the first rack such that the adjustable member can adjust the meshing position of the second rack and the first rack.

8. The adjustable wrench as claimed in claim 1, wherein the engaging element comprises:

a fixture, using a pivot point to pivot to the frame; and a fourth elastic element, disposed on the frame and contacting the fixture with a positioning member of the fixture to provide a restoring elastic force such that the fixture can hold the adjustable element; after the fixture is pressed, the fixture can release the adjustable member so that the adjustable member can be moved to adjust the meshing position of the second rack and the first rack.

9. The adjustable wrench as claimed in claim 1, further comprising a handle connected with the frame.

10. The adjustable wrench as claimed in claim 9, wherein the handle is connected to two frames simultaneously.

* * * * *